United States Patent [19]

Sakurai et al.

[11] Patent Number: 4,556,462

[45] **Date of Patent: * Dec. 3, 1985**

[54] METHOD FOR PRODUCING A LITHOGRAPHIC PRINTING PLATE

[75] Inventors: Kiyomi Sakurai; Seiji Arimatsu, both of Neyagawa, Japan

[73] Assignee: Nippon Paint Co., Ltd., Osaka, Japan

[ * ] Notice: The portion of the term of this patent subsequent to Nov. 6, 2001 has been disclaimed.

[21] Appl. No.: 632,856

[22] Filed: Jul. 20, 1984

Related U.S. Application Data

[60] Division of Ser. No. 454,554, Dec. 30, 1982, Pat. No. 4,480,549, which is a continuation of Ser. No. 244,648, Mar. 17, 1981, abandoned.

[30] Foreign Application Priority Data

Mar. 17, 1980 [JP] Japan ..... 55-34641
Mar. 17, 1980 [JP] Japan ..... 55-34642

[51] Int. Cl.[4] ..... C25D 1/04; C25D 1/20
[52] U.S. Cl. ..... 204/6; 204/13
[58] Field of Search ..... 204/6, 13, 38 E

[56] References Cited

U.S. PATENT DOCUMENTS

| | | | |
|---|---|---|---|
| 109,551 | 11/1870 | Rye | 101/456 |
| 308,043 | 11/1884 | Shaw | 204/13 |
| 748,004 | 12/1903 | Pancoast | 101/459 |
| 880,484 | 2/1908 | Edison | 204/13 |
| 884,075 | 4/1908 | Coles | 204/12 |
| 951,103 | 3/1910 | Cornwall | 101/459 |
| 987,318 | 3/1911 | Pfanhausser | 204/12 |
| 1,069,857 | 8/1913 | Cornwall | 101/459 |
| 1,562,324 | 11/1925 | Grass | 101/456 |
| 1,938,667 | 12/1933 | Richards | 101/456 |
| 2,128,389 | 8/1938 | Young | 204/13 |
| 2,214,950 | 9/1940 | Aller | 101/459 |
| 2,258,956 | 10/1941 | Misuraca | 101/456 |
| 2,291,854 | 8/1942 | Whyzmuzis | 101/459 |
| 2,583,100 | 1/1952 | Wilson | 204/12 |
| 2,687,373 | 8/1954 | Hering | 101/456 |
| 2,880,147 | 3/1959 | Cunningham | 204/12 |
| 2,922,715 | 1/1960 | Gumbinner | 101/456 |
| 3,161,517 | 12/1964 | Doggett | 430/160 |
| 3,556,952 | 1/1971 | Fry | 101/458 |
| 3,958,994 | 5/1976 | Burnett | 101/458 |
| 4,032,684 | 10/1976 | Dunnington et al. | 428/332 |
| 4,480,549 | 11/1984 | Sakurai | 204/6 |

FOREIGN PATENT DOCUMENTS

| | | | |
|---|---|---|---|
| A2283462 | 3/1976 | France | 101/459 |
| 1413110 | 11/1975 | United Kingdom | 101/459 |

*Primary Examiner*—T. M. Tufariello
*Attorney, Agent, or Firm*—Wenderoth, Lind & Ponack

[57] ABSTRACT

A method for producing a lithographic printing plate which comprises, as a support, an iron foil prepared by electroforming and electroplated with a hydrophilic metal on both surfaces, and an oleophilic image on the surface of the iron foil in contact with the electrolyte during the electroforming.

6 Claims, 3 Drawing Figures

METHOD FOR PRODUCING A LITHOGRAPHIC PRINTING PLATE

Figure 1:
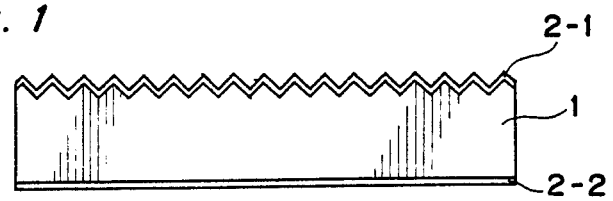

This is a Rule 60 divisional application of Ser. No. 454,554, filed Dec. 30, 1982 which, in turn, is a continuation application of Ser. No. 244,648, filed Mar. 17, 1981, now abandoned.

The present invention relates to a novel lithographic printing plate. More particularly, it relates to a lithographic printing plate which can be offered at a low cost.

The lithographic printing plate is a plate in which an image area and a non-image area are present on a thin plate of 0.1 to 0.5 mm in thickness. The image area is required to have such properties as oil-philic property and water repellency, and the non-image area as hydrophilic property, water-retention and ink-repellency. Usually, the image area is composed of an organic photosensitive layer and the non-image area is composed of a metal. By the combination of the materials for the non-image area and the image area, various kinds of printing plate types are in use, from among which there may be employed the plate type that will meet the desired objectives from the standpoint of workability, economy, number of copies to be printed, etc.

The present invention is directed to a printing plate type which is offered at an especially a low cost by the use of an iron foil. More particularly, it is characterized by using an extremely thin iron foil, which is produced by the electroforming process and plated with a metal, as a support on which an oleophilic image is provided at the surface in contact with the electrolyte on the electroforming.

According to this invention, there is provided a a lithographic printing plate which comprises as a support an iron foil prepared by electroforming and electro-plated with a hydrophilic metal on both surfaces, and an oleophilic image on the surface of the iron foil, which surface was in contact with the electrolyte during the electroforming.

The electroforming process, i.e. production of a pure iron formed product by electroplating, has hitherto been well known, and it is a technique generally adopted as, for example, a method for duplicating a metal form. By this technique, it is possible to produce an iron foil by peeling off from the negative electrode the iron component which precipitated at said negative electrode immersed in an electrolyte containing iron ions. In this case, by using a negative electrode in a roll-form and peeling off the iron component from said negative, it is possible to continuously produce an iron foil. The iron foil thus produced has characteristics such that, while the surface which is in contact with the negative electrode is finished in such manner as to copy the surface form of the negative electrode, i.e. finished into a smooth surface, the surface which is not in contact with the negative electrode, i.e. the surface in contact with the electrolyte, is formed into a minute rough surface due to gradual precipitation of iron. This iron surface has a rough surface similar to that of the surface-treated aluminum plate which is conventionally used for preparation of a lithographic printing plate. Such surface treatment is usually carried out by polishing an aluminum plate surface and etching to form a rough surface, thereby providing the necessary water-retaining property or improving its adhesion to an organic photosensitive layer. Since the iron foil as produced readily rusts, it must be plated with a metal on both surfaces. It is desirable that the thickness of the metal plating layer is in the range of 0.01 to 5$\mu$, within which the surface roughness of the iron foil obtained through the electroforming is not substantially deteriorated.

As the metal for metal electro-plating, one having a high hydrophilic property is preferably used. Examples of such metal are zinc, chromium, nickel, etc. When provided with such a hydrophilic metal plating, one surface of the iron foil, which is smoother, has insufficient water-retaining property, weak adhesion force to the organic photosensitive layer, is unsuitable as a support for a lithographic printing plate, but the other surface, which is rougher, is sufficiently rough and has satisfactory hydrophilic and water-retaining properties and a sufficient adhesion force to the organic photosensitive layer. Thus, it is usable as a support for a lithographic printing plate, like a conventional aluminum plate support.

The thickness of the iron foil is usually from 3 to 150$\mu$, preferably from 10 to 100$\mu$. Due to its extreme thinness, the iron foil is light in weight, and different from a steel foil produced by rolling, the cut surface is not like the razor's edge so that the foil can be safely handled.

It is a conventional technique to produce a lithographic printing plate by coating an organic photosensitive layer on a hydrophilic metal surface such as zinc or aluminum. But, since zinc is a spreadable material, it exhibits poor size precision as a printing plate, and it must be subjected to surface treatment by polishing with a brush or a ball. Aluminum plate also requires polishing, and depending on use, it must be subjected to anodic oxidation treatment to obtain sufficient durability during printing. In the present days in which the energy cost has advanced in consequence of the drastic rise of the crude oil price, the use of aluminum which consumes a large amount of electricity in refining must be considered undesirable from the aspect of the energy saving.

With regard to the iron foil made by the electroforming process, no problem of spreading as in the zinc plate is involved irrespective of the quality of the surface electro-plating material, because the iron is a material which shows scarce spreading or shrinkage. Moreover, since the surface roughness of the iron foil not in contact with the negative electrode during the electroforming process shows an optimum roughness to the properties of water-retention and adhesion, the iron foil has the merit of being directly usable without requiring any surface treatment. Further, as the iron foil has a thermal expansion coefficient nearly half that of the aluminum plate, its size precision against temperature is stabilized.

The present invention will be hereinafter explained in detail in accordance with the accompanying drawing. In the drawings, FIG. 1 is a cross-sectional view of an iron foil, wherein 1 is iron, and 2 is a layer electro-plated with a hydrophilic metal (e.g. zinc, chromium, nickel). Depending on the kind of the metal to be electro-plated, the electro-plated surface may be subjected to chemical treatment, if necessary. For example, the zinc-plated surface may be treated with chromic acid to convert zinc into zinc chromate. Zinc chromate is somewhat inferior in hydrophilicity to zinc, but it is effective in improving storage stability and durability in printing.

The disadvantage due to the inferior hydrophilicity can be overcome by subjecting the zinc chromate surface of the non-image area to treatment with a desensitizer. As the desensitizer, a conventional aqueous solution containing an acid or a metal ion can be used. On the manufacture of an iron foil, the surface 2-1 which is in contact with the electrolyte is formed into a rough surface, and the surface 2-2 is smooth.

Figure 2:
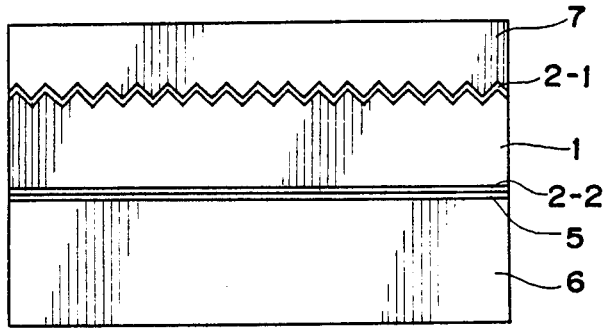

FIG. 2 is a cross-sectional view of a photosensitive plate comprising an iron foil 1, a reinforcing sheet 6 bonded on the smooth surface 2-2 of said foil by the use of an adhesive 5 and a photosensitive resin layer 7 coated on the rough surface 2-1 of said foil.

Figure 3:
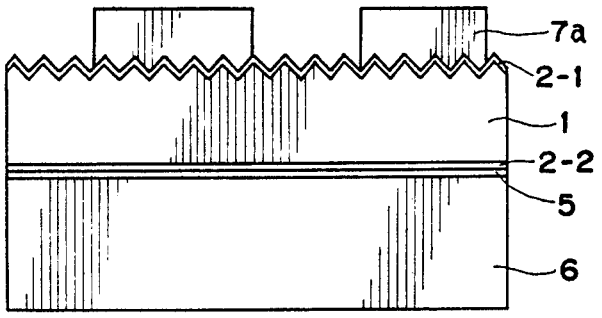

FIG. 3 is a lithographic printing plate having an oleophilic image portion *7a* made by exposing and developing the photosensitive resin.

As the reinforcing sheet 6 in FIG. 2, there may be used any cheap material such as paper, cloth, non-woven fabric, plastic resin, synthetic paper, etc., preferably having a water-resistant property or treated for imparting such property. Examples of the plastic resin are polyethylene, polypropylene, polyvinyl chloride, nylon, polyester, etc. As the synthetic paper, there may be used the one made of a plastic material such as polyethylene or polypropylene mixed with a pigment or the one made of a mixture of plastic fibers with natural pulp. The adhesive 5 serves to laminate the reinforcing sheet 6 and the iron foil 1. Any conventional adhesive may be used. The photosensitive resin layer 7 may be formed by applying a photosensitive resin to the rough surface 2-1 of the iron foil. As the photosensitive resin, there may be used any conventional one such as a bichromic acid colloid photosensitive liquid, a diazo resin, a p-quinone diazide, polyvinyl cinnamate or a light-solubilizable type composition utilizing o-quinone diazide. The photosensitive resin may be applied directly onto the metal plated surface 2-1. Alternatively, a thin hydrophilic coating film is first formed on the surface 2-1, for instance, by application of a water-soluble high molecular electrolyte solution, and then the photosensitive resin may be applied thereto. The said film is effective for preventing scumming, improving the adhesive property between the photosensitive resin and the surface of the iron foil and enhancing the storage stability.

The oleophilic image *7a* in FIG. 3 may be produced by the use of the above mentioned photosensitive resin. Any other image such as the toner image by an electrophotography system, the drawn image by the use of a ball point pen or an oil ink, the image formed by typewriting or the like may be also used.

The lithographic printing plate obtained as above is substantially equal to a conventional printing plate using an aluminum plate in quality but drastically lowered in cost.

Practical and preferred embodiments of the present invention are illustratively shown in the following examples, wherein % is by weight.

EXAMPLE 1

An iron foil ("IRON FOIL" manufactured by Toyo Kohan Co., Ltd. by the electroforming process; foil thickness, 30μ; zinc electro-plating thickness, 1.4μ) had a roughness of 8.5μ in average at the surface in contact with the electrolyte, and a roughness of 1.5μ on the average at the surface in contact with the negative electrode. After laminating the surface having a roughness of 1.5μ with an adhesive-applied polyester film of 100μ in thickness, the laminated product was subjected to alkali degreasing, and the iron foil surface was coated with a positive type photosensitive resin which consists of o-quinone diazide and dried at 70° C. for 2 minutes.

To the photosensitive resin layer thus formed, a positive film was set in tight contact, to which a 3 KW high pressure mercury lamp was projected from a distance of 70 cm for 45 seconds. Thus, the plate surface was washed with a developer, and the photosensitive resin on the exposed parts was washed out, followed by washing with water and drying to obtain a lithographic printing plate. The lithographic printing plate was used for printing on an offset printer to give a clear printed matter.

EXAMPLE 2

The same zinc-plated iron foil as in Example 1 was used. After subjecting to alkali degreasing, it was dipped in an aqueous solution comprising 1.5% anhydrous chromic acid and 0.1% hydrochloric acid for 1 minute. The roughness of the treated iron foil was 5.5μ on the average at the surface in contact with the electrolyte and 1μ in average at the surface in contact with the negative electrode. After laminating the thus treated iron foil with a polyester film having a thickness of 100μ at the surface having a roughness of 1μ, the same positive type photosensitive resin as in Example 1 was applied to the iron foil surface of the laminated product, followed by drying at 70° C. for 2 minutes. Onto the photosensitive resin layer, a positive film was set in tight contact, to which a 3 KW high pressure mercury lamp was projected from the distance of 70 cm for 45 seconds. The exposed surface was developed with an alkali developer, washed with water and dried. Then, a finishing rubber liquid was applied to the whole surface and dried in an atmosphere to obtain a lithographic printing plate. The lithographic printing plate was used for the printing on an offset printer to give a clear printed matter.

EXAMPLE 3

An iron foil ("IRON FOIL" manufactured by Toyo Kohan Co., Ltd. according to the electroforming process; foil thickness, 35μ; chromium-electro-plating thickness, 0.1μ) had a roughness of 6.5μ on the average at the surface in contact with the electrolyte and 2μ in average at the surface in contact with the negative electrode. A sheet of the iron foil was laminated with a synthetic paper of 200μ in thickness having an adhesive layer on one side at the surface having a roughnesss of 6.5μ. Another sheet of the iron foil was laminated with the same synthetic paper as above at the surface having a roughness of 2μ. Onto the iron foil surface, a negative type photosensitive resin which consists of diazo resin was applied, followed by drying at 70° C. for 2 minutes. The photosensitive resin layer was cured with negative images and developed with a developing lacquer to obtain a lithographic printing plate. The plate provided with the photosensitive resin layer on the surface of the iron foil in contact with the electrolyte formed good images to produce a satisfactory printed matter, but the plate provided with the photosensitive resin layer on the surface in contact with the negative electrode showed a partial disappearance of images during developing and an insufficient adhesive property.

EXAMPLE 4

An iron foil ("IRON FOIL" manufactured by Toyo Kohan Co., Ltd. by the electroforming process; foil thickness, 20μ; nickel plating thickness, 2μ) had a roughness of 4μ on the average at the surface in contact with the electrolyte and a roughness of 1μ in average at the surface in contact with the negative electrode. A sheet of iron foil was laminated with the same synthetic paper as in Example 3 at the surface having a roughness 4μ. Another sheet of the iron foil was laminated with the same synthetic paper as above at the surface having a roughness of 1μ. Onto the iron foil surface, a negative type photosensitive resin as in Example 3 was applied, followed by drying at 70° C. for 2 minutes. In the same manner as in Example 3, the photosensitive resin was developed to obtain a lithographic printing plate. The printing plate was treated with a wetting water, and an ink was placed on the surface. The plate provided with the photosensitive resin layer on the surface having a roughness of 4μ showed satisfactory results, but the plate provided with the photosensitive resin layer on the surface having a roughness of 1μ showed the deposition of the ink on the non-image portion to cause scumming and could not be used for printing.

EXAMPLE 5

By the use of the same iron foil as in Example 1, treatment was made in the same manner as in Example 3 to prepare two plates, one having the plate surface roughness of 8.5μ on the average and the other having the plate surface roughness of 1.5μ in average. The same photosensitive resin as in Example 3 was applied also to the surface of an iron plate having a thickness of 80μ, which was prepared by rolling and electro-plated with zinc. The results of treatment of these three plates in the same manner as in Example 3 are shown in Table 1. As will be observed from the table, the use of the surface of the iron foil in contact with the electrolyte gives a good result, while the use of the surface in contact with the negative electrode shows an inferior result like the use of a rolled iron plate.

TABLE 1

| Sample No. | Kind | | Electro-plating | Roughness (average) (μ) | Printing plate | Printing result |
|---|---|---|---|---|---|---|
| 1 | Iron foil | Electrolyte surface | Zinc | 8.5 | Good | Good |
| 2 | | Negative electrode surface | Zinc | 1.5 | Image partly disappeared | Apt to cause scumming |
| 3 | Rolled iron plate | | Zinc | 1.5 | Image partly disappeared | Apt to cause scumming |

What is claimed is:

1. A method for producing a lithographic printing plate which comprises:

(a) providing a support comprising an iron foil prepared by electroforming, wherein one surface of said foil is in contact with an electrolyte and the opposite surface is in contact with a negative electrode, said surface in contact with said electrolyte having a relatively rough surface compared to said surface in contact with said negative electrode and wherein the porosity of said surface in contact with said electrolyte is about 4–8.5μ, said foil being electroplated with a hydrophilic metal on both surfaces to form a hydrophilic metal layer sufficiently thin as to substantially retain the porosity of the iron foil, and (b) providing an oleophilic image area formed from a photosensitive resin on said surface of the hydrophilic metal coated iron foil, which was in contact with said electrolyte and a non-image area where said resin is not present on said surface of said hydrophilic metal coated iron foil which was in contact with said electolyte, said non-image area exhibiting good hydrophilic and water retentive properties in lithographic printing.

2. The method according to claim 1, wherein the iron foil is laminated with a reinforcing sheet on the surface which was in contact with the negative electrode during the electroforming.

3. The method according to claim 2, wherein the reinforcing sheet is made of paper, cloth, non-woven cloth, plastic resin or synthetic paper.

4. The method according to claim 1, wherein the hydrophilic metal is zinc, chromium or nickel.

5. The method according to claim 1, wherein the iron foil has a thickness of 0.003 to 0.150 mm.

6. The method according to claim 1 wherein the porosity of the surface in contact with the negative electrode is 1 to 2μ.

* * * * *